US005648751A

United States Patent [19]

Yuyama et al.

[11] Patent Number: 5,648,751

[45] Date of Patent: Jul. 15, 1997

[54] DRUG PREPARATION TRAY

[75] Inventors: Shoji Yuyama; Tsuyoshi Kodama, both of Toyonaka, Japan

[73] Assignee: Kabushiki Kaisha Yuyama Seisakusho, Osaka, Japan

[21] Appl. No.: 359,638

[22] Filed: Dec. 20, 1994

[30] Foreign Application Priority Data

Nov. 7, 1994 [JP] Japan ..... 6-272037

[51] Int. Cl.[6] ..... G08B 1/00

[52] U.S. Cl. ..... 340/309.15; 340/309.3; 340/309.4; 368/10

[58] Field of Search ..... 340/309.15, 309.3, 340/309.4, 309.5, 309.6, 286.01, 331, 332; 368/10

[56] References Cited

U.S. PATENT DOCUMENTS 4,293,845 10/1981 Villa-Real ..... 340/309.15

4,504,153 3/1985 Schollmeyer et al. ..... 340/309.4

4,682,299 7/1987 McIntosh et al. ..... 340/309.15

4,893,230 1/1990 Shimomura et al. ..... 340/309.15

5,408,443 4/1995 Weinberger ..... 340/309.15

*Primary Examiner*—Jeffery Hofsass

*Assistant Examiner*—Edward Lefkowitz

*Attorney, Agent, or Firm*—Wenderoth, Lind & Ponack

[57] ABSTRACT

A drug tray is for containing all drugs prescribed for each patient, and includes a display unit for providing an indication of the drugs which have been placed in the tray. The display unit has a signal transmitter/receiver, drug type indicating switches, time key, reset key, etc. The drug tray eliminates the conventional need for a large shelf for collecting drugs needed for a number of patients.

8 Claims, 6 Drawing Sheets

DRUG PREPARATION TRAY

BACKGROUND OF THE INVENTION

This invention relates to a hand-carriable drug preparation tray for containing different drugs for one patient.

At hospitals, drugs including powdered drugs, tablets, drugs for external applications and liquid drugs, are filled, selected, packed and delivered to a pharmacy window according to a prescription or prescription-based instruction sheet for each patient. These steps are carried out fully automatically in some hospitals, partially automatically in other hospitals, and completely manually in other hospitals.

Aside from the case in which the drug preparation steps are carried out completely automatically, drugs prepared and selected for each patient on a drug preparation table are usually hand-carried from the preparation tables to a predetermined position of a shelf for each patient. Some of such shelves are provided with lamps corresponding to e.g. powdered drugs, tablets and liquid drugs. When all the lamps are turned off or on, the pharmacist knows that the drug preparation for one patient has been completed.

In this arrangement, drug preparation is very troublesome because different kinds of drugs for each patient have to be prepared at different places and carried to one place in the shelf.

Moreover, the shelf has to be large enough to store drugs for a relatively large number of patients so that the drugs can all be prepared at once. Such a large shelf can take up a big space in a small pharmacy.

An object of this invention is to provide a hand-carriable drug preparation tray having a display unit for indicating the types of drugs in the tray so that pharmacists can check the contents of the tray while collecting drugs.

SUMMARY OF THE INVENTION

According to the present invention, there is provided a drug preparation tray comprising a box-shaped tray which can accommodate drugs, and a display unit mounted to the tray, the display unit including an input unit for supplying data denoting patients' names or codes kinds of drugs, a plurality of switches, a control unit for generating control signals in response to the data, and a display unit for indicating at least the kinds of drugs and patients' names or codes in response to the control signals.

The display unit may be detachable from the tray or integral therewith.

The input unit may have a signal transmitter/receiver for transmitting and receiving signals denoting patients' names and data denoting the kinds of drugs from an external source in a non-contact manner.

Preferably, the input unit has a plurality of kinds of keys and switches including a timer key, a reset key or drug type indicating switches.

Such a drug preparation tray may further comprise an audio signal generating means for indicating the fact that a predetermined time has passed since data signals were transferred to the input unit or the fact that the drug preparation process has been completed.

A plurality of trays and display units are prepared according to the number of patients expected. The drugs for each patient are classified roughly e.g. into powders, tablets, liquid drugs and drugs for external application and accommodated separately in different spaces. The display unit of each tray indicates which type of drugs are accommodated in the tray.

Patients' names are indicated on the display in the form of letters or codes, while drug types for each patient are indicated in the form of codes. If patients' names are indicated in codes, such codes may be an entry number, an outpatient pass number, or any other number or code that is ordinarily used in hospitals to identify patients.

A tray for each patient is hand-carried to drug preparation stations for preparing different types of drugs to collect all the necessary drugs for the patient. When all the drug type indicating lamps are turned on, this means that drug preparation for this patient has been completed.

If it is necessary to prepare many kinds of and/or large amounts of drugs for a certain patient, it may be difficult to collect all the necessary drugs at the same time. In such a case, the tray may be temporarily stored on a shelf, indicating on the display the patient's name and the drug types that have been collected so far. When the remaining drugs have been prepared, this tray is hand-carried to the drug preparation stations to collect the remaining drugs.

The input unit may include various keys and switches such as a timer key, a reset key, and drug type indicating switches. When necessary data are transferred from the host computer through accessing means into the input unit, the timer starts. When the timer key is pressed or a predetermined time has passed since the timer started, the time elapsed from starting of the timer is indicated on the display.

Warning information in the form of audio signals may be given upon the lapse of a predetermined time period. Also, by pressing the reset key, it is possible to indicate data of any previous step on the display and thus to correct any previous entry error including misoperation of the drug type indicating switches. It is even possible to indicate the initial data on the display.

The drug preparation tray according to the present invention eliminates the conventional need for a large shelf which can store drugs for a large number of patients. Instead, drugs for each patient can be collected efficiently by hand-carrying the tray around the drug preparation stations and putting the necessary drugs in the tray. Simply by checking the indication on the display unit, one can see whether or not all the necessary drugs have been collected in the tray.

In the arrangement in which the input unit has a timer key, a reset key, and drug type indicating switches, it is possible to indicate the time taken for drug preparation, the time exceeding a predetermined time, the fact that drug preparation has been completed, etc.

Other features and objects of the present invention will become apparent from the following description made with reference to the accompanying drawings, in which:

DETAILED DESCRIPTION OF THE PREFERRED EMBODIMENT

Figure 1A:
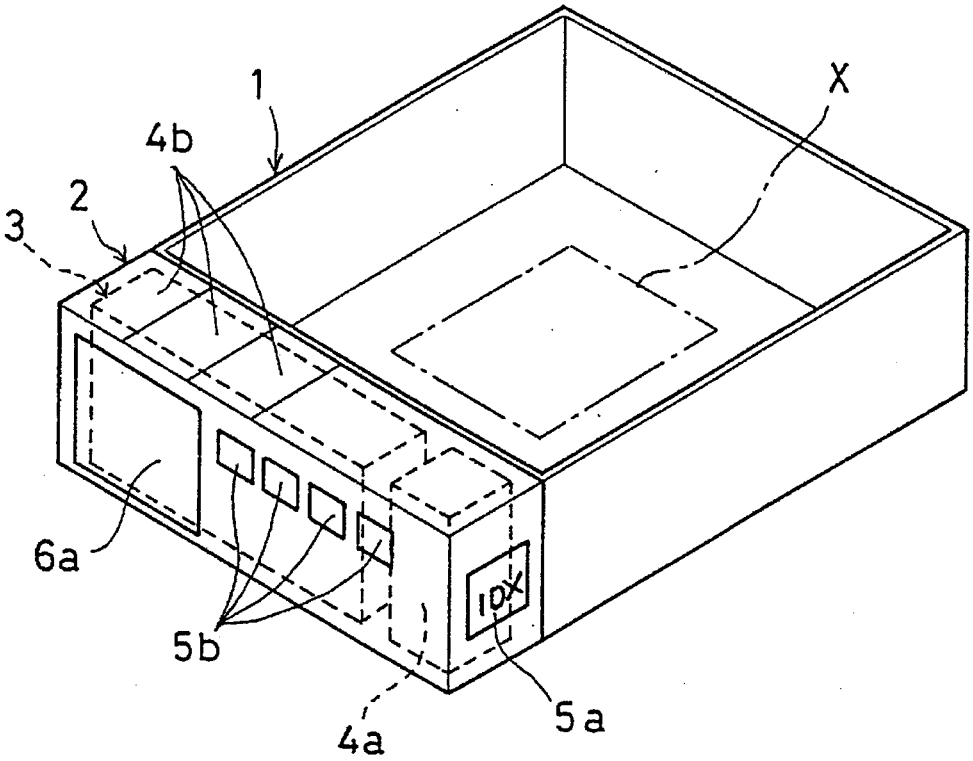
FIG. 1A is a perspective view of a drug preparation tray of one embodiment.

Referring now to the drawings, embodiments of this invention will be described.

A drug preparation tray 1 is a top-open shallow vessel and has a suitable size for putting drugs therein and hand-carrying. It may be formed from any material light enough for hand-carrying, such as wood, paper and metal. Its shape is not limited to that shown. For example, it may carry a lid or may be partially opened on both sides.

Figure 1B:
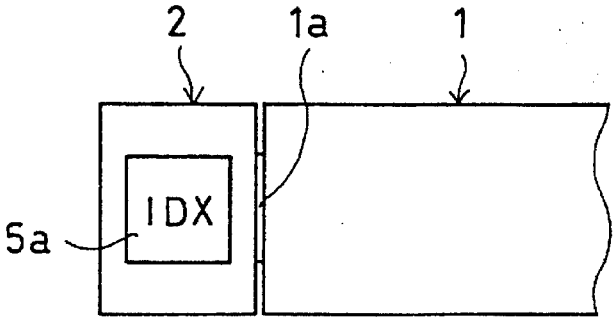
FIG. 1B is its partial side view.

A display unit 2 is mounted to one side of the tray. It is detachably mounted to the tray 1 so that different types of display units 2 can be used in combination with different types of trays 1. As shown in FIG. 1B, the display unit 2 is detachably mounted to the tray 1 by means of hook-and-loop fasteners 1*a*. The size and number of such fasteners 1*a* should be determined according to the size of the display unit 2.

It is also possible to detachably mount the display unit 2 to the tray 1 in other ways. For example, the display unit 2 may be connected to one side of the tray 1 by means of fittings provided on the side of the tray or simply by bolts and nuts. Mounted in the display unit 2 are a controller 3, a power source 4 and an input 5. A display 6 is provided on the surface.

Figure 2:
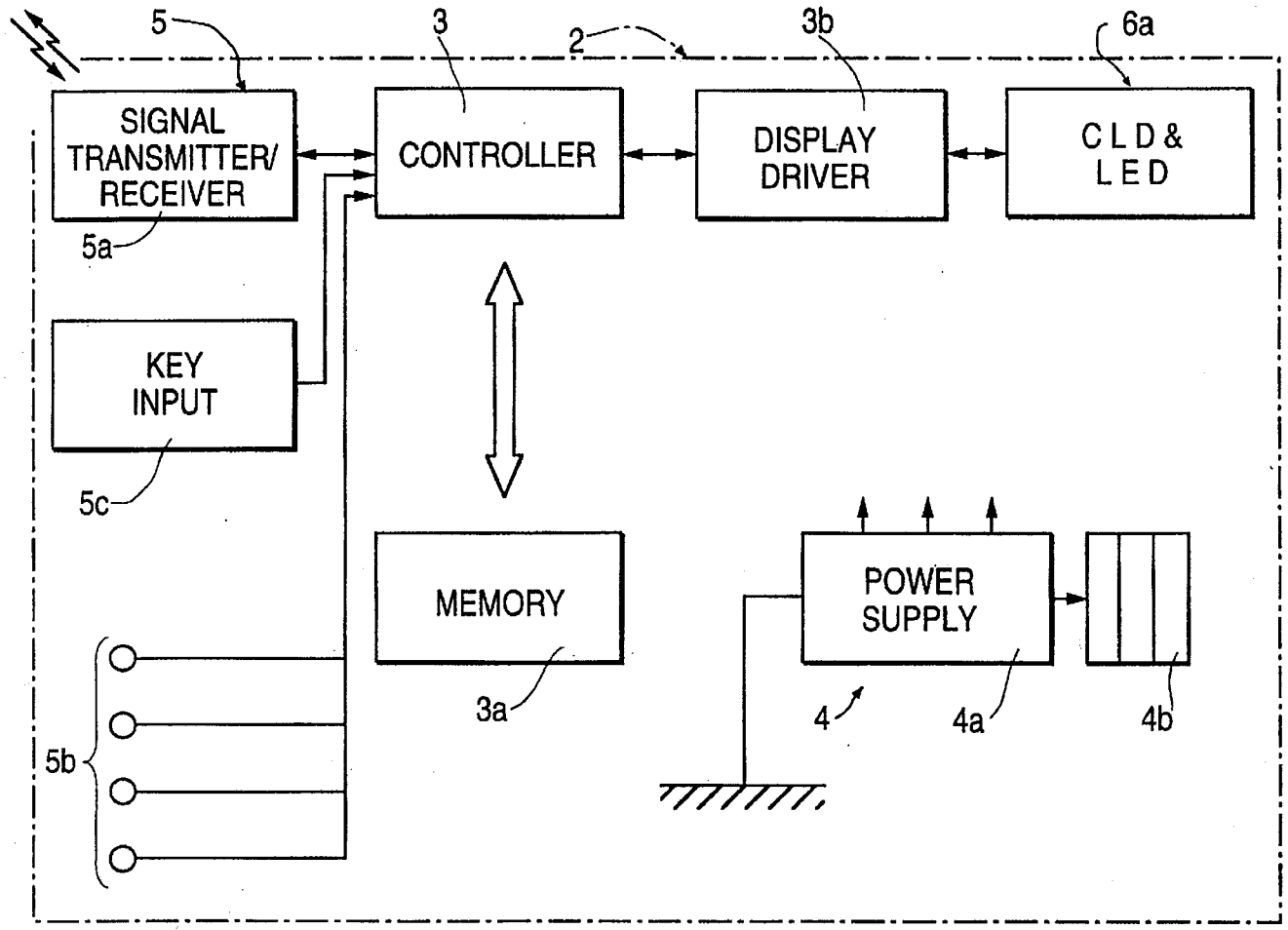
FIG. 2 is a block diagram of a control circuit of a display unit of the same.

FIG. 2 is a block diagram of the control circuit in the display unit 2. The controller 3 has a memory 3*a* and a display driver 3*b*. The power source 4 has its own battery 4*a* and is further connected to a solar battery 4*b*. One of the batteries 4*a* and 4*b* may be omitted. The input 5 comprises a signal transmitter/receiver 5*a*, drug type indicating switches 5S and a keyboard 5*c*. The display 6 is a liquid crystal display.

A signal transmitter/receiver 5*a* is provided on the other side of the display unit 2 and used to input patients' names or codes. It has an IDX in the form of a non-contact type IC card carrying a read/write IC memory. In response to light signals transmitted from a light transmitter/receiver fixed in a suitable position in the pharmacy, necessary data are written into or read out of the IC card. The IDX may be replaced by a unit that utilizes electric wave or ultrasonic signals.

The input 5*a* may be replaced by the keyboard 5*c*, or both the input 5*a* and the keyboard 5*c* may be provided. Such keyboards are used to input drug-related data if manual input is more convenient than inputting such data from the computer or if the computer should break down.

One of the drug type indicating switches 5*b* is closed every time one kind of drug for one patient has been put in the tray to indicate this fact on the display.

The liquid crystal display 6a of the embodiment can indicate the instruction data in prescriptions, one line at a time. And instead, a display which can display the entire instruction data in one prescription at a time may be used. Conventionally, the letters or codes in each line that represent each drug should be indicated in a different color from the other lines so that viewers can easily distinguish the differences in drugs.

The tray of this embodiment is used in the following manner.

As mentioned earlier, display units 2 can be detachably mounted to trays 1. Thus, if one display unit 2 mounted to one tray 1 should malfunction, it is possible to replace this display unit 2 with another display unit 2.

Prescribed drugs are roughly classified into tablets, powdered drugs, liquid drugs, and external application drugs. In each of the trays are put some or all of the above four types for each patient. Each time the drug prescribed for each patient is put in one tray, a correct one of the switches 5*b* corresponding to the drug is pressed.

Drugs are prepared in a variety of ways. Some pharmacies may have a facility which can prepare and pack drugs fully automatically. Other pharmacies having no such facility have to prepare and pack drugs fully manually.

When the drugs of one type for one patient are put in a tray, the switch corresponding to tablets is pressed. Then, the tray is hand-carried to another preparation table. When all the drugs prescribed for one patient are put in the tray and the corresponding drug type indicating switches are closed, this fact is indicated on the display and the tray is carried to the final inspection station.

In this embodiment, the display unit 2 is detachably mounted to the tray 1, but they may be integral with each other. In this case, some of the parts of the display unit 2 may be provided on the tray 1.

Figure 3A:
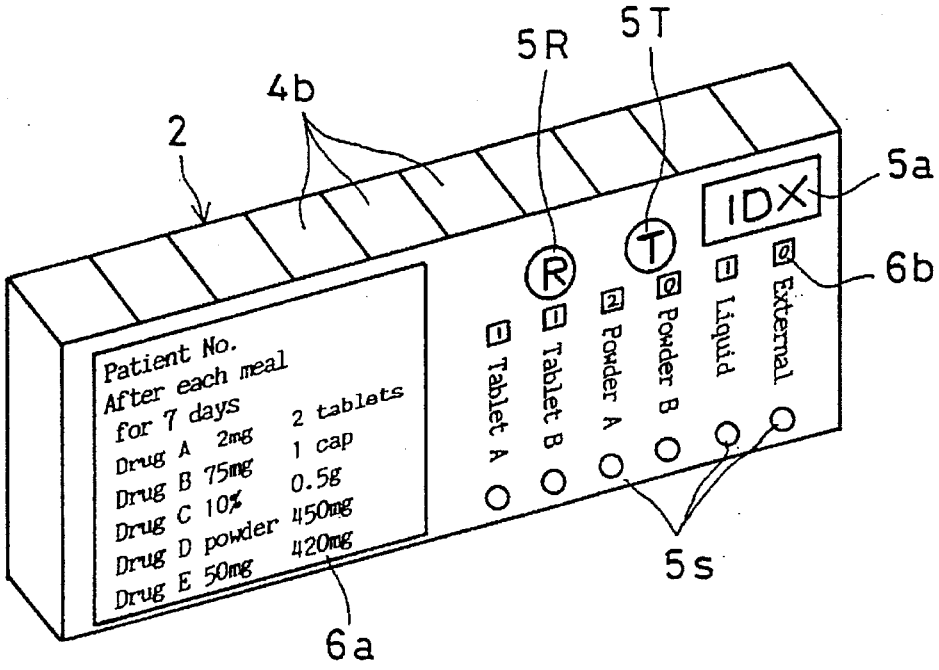
FIG. 3A is a perspective view of a display unit for a drug preparation tray of another embodiment.

FIGS. 3–7 show the drug preparation tray of the second embodiment. The function of the drug preparation tray shown in FIG. 3 is basically the same as the first embodiment. It only differs in details of functions. Thus, only the elements that are different from the first embodiment will be described. The same functional elements are denoted by the same numerals and their description is omitted.

Figure 3B:
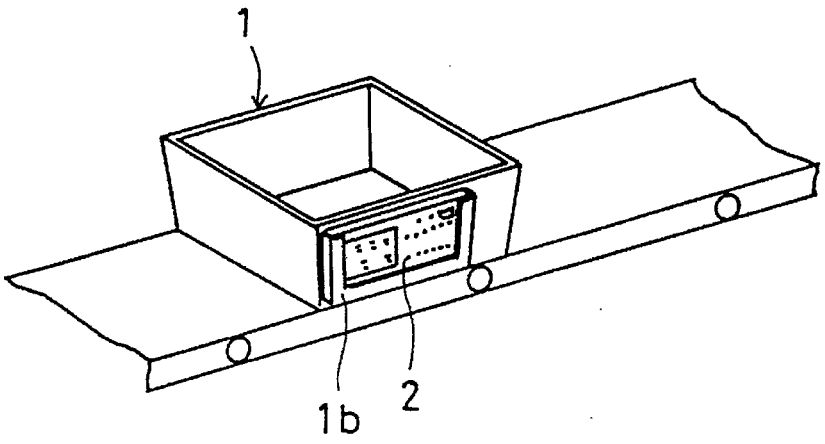
FIG. 3B is a perspective view of the drug preparation tray of the same.

The display unit 2 is detachably mounted to the tray 1 as in the first embodiment but in a different manner. Namely, as shown in FIG. 3B, it is detachably mounted on the tray 1 through a frame 1*b*. The drug preparation tray of this invention is not only hand-carriable but can be transported on a conveyor line.

The display unit 6 has a liquid crystal display 6*a* and six LED displays 6*b*. The liquid crystal display 6*a* has such a size and function that it can indicate the letters, figures and marks that represent the drug names prescribed for each patient and the patient's name. The LED displays 6*b* indicate the number of times the corresponding switches 5S are pressed.

Figure 4:
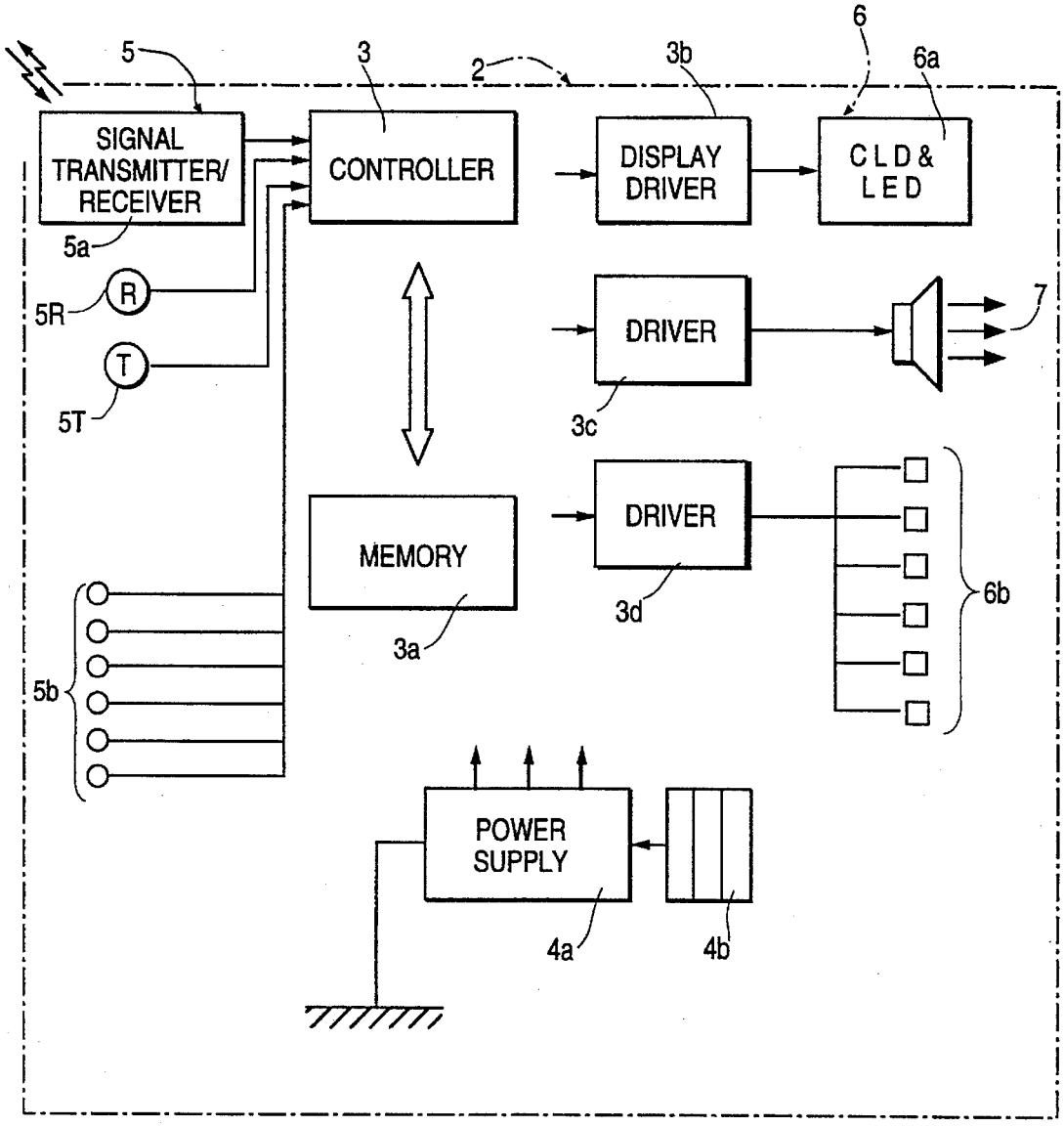
FIG. 4 is a block diagram of a control circuit of the display unit of the same.
Figure 5:
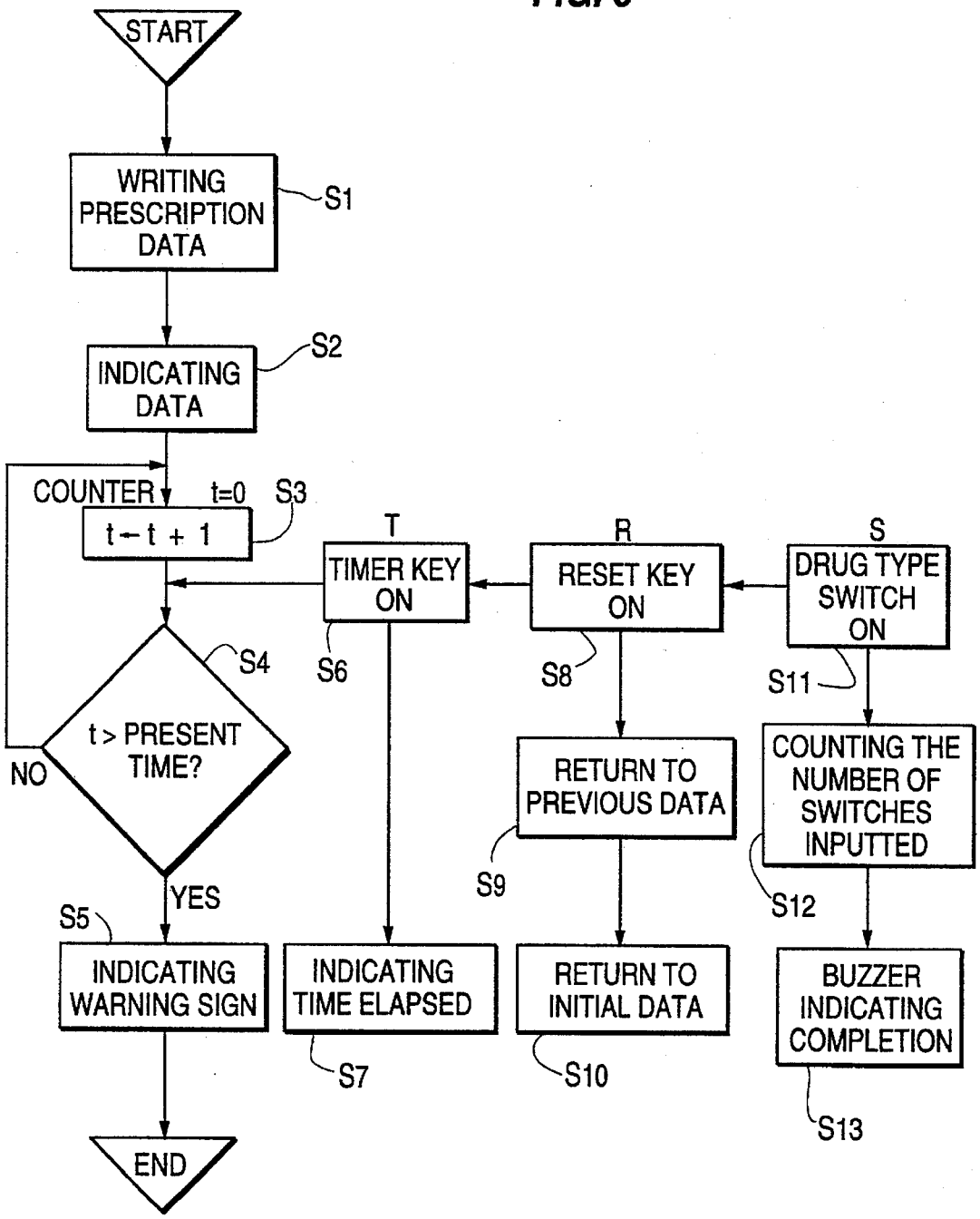
FIG. 5 is a flowchart showing the control sequence of the display unit of the same.

FIG. 4 shows a block diagram of the control circuit of this embodiment. Though not shown in FIG. 3, this circuit has an audio signal generator 7 and its driving units 3*c*, 3*d*.

The drug preparation tray of this embodiment can not only indicate drug preparation data and the types of drugs put in the tray, but can indicate various other data such as warning data. Such data are indicated according to the flow chart shown in FIG. 5.

When the data signals about patients' names and the kinds of prescribed drugs are transferred from an external computer (not shown) into the signal transmitter/receiver 5*a* of the input unit 5, these prescription data are written in the memory 3*a* (Step S1). In Step S2, these data are indicated on the liquid crystal display 6*a*.

Figure 6A:
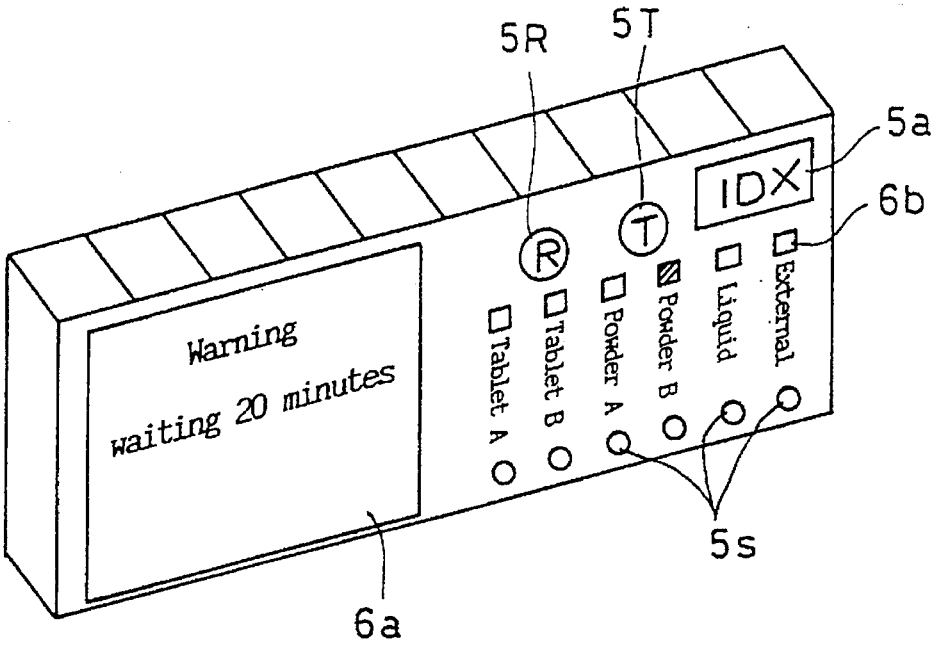
FIG. 6A and 6B illustrate data indicated on the display unit.
Figure 6B:
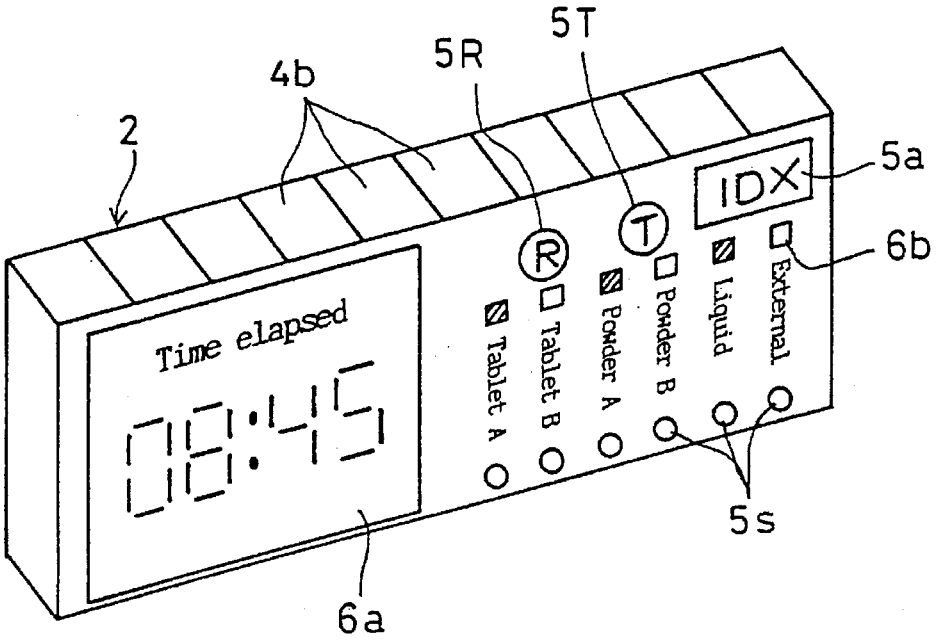

When the data for one patient has been written and indicated on the display, the timer is cleared (t=0). In Step S3, the timer is set and the elapsed time is counted on a counter. In Step S4, judgement is made as to whether the elapsed time has exceeded a predetermined time t. If No, the program returns to Step S3. If Yes, a warning sign, such as shown in FIG. 6A, is indicated on the display (Step S5). This warning sign indicates that the drug preparation period starting from the input of necessary data has exceeded a standard period within which the drug preparation should be completed. It urges the pharmacist to quicken the work. In this case, a buzzer may be sounded simultaneously when indicating the warning sign.

During and independently of the time-counting steps, the timer key 5T, reset key 5R or drug type indicating switches 5S may be operated. By operating these keys and switches, the main flow of the program is interrupted. The timer key 5T is used to check the elapsed time. Namely, by pressing this key, the time elapsed since the prescription data were transferred and written is indicated on the display in place of the warning sign (see FIG. 6B).

The function of the drug type indicating switches 5S will be described. In this embodiment, six drug type indicating switches 5S are used which represent tablets, tablets packed, powdered drugs, powdered drugs packed, liquid drugs and external application drugs, respectively. Every time one of the switches 5S is pressed (Step S11), the number is counted on the LED display 6b by one (Step S12) (see FIG. 3A). When the number on the displays *6b* coincides with the number of types of the drugs specified in the prescription, a buzzer is sounded to indicate the completion of drug preparation for one patient (Step S13). This buzzer should have a different frequency or be sounded at different intervals/pulses from the warning buzzer so that they are distinguishable from each other.

By pressing the reset key 5R once (Step S8), the data one step before is indicated on the display. By pressing this key a required number of times, the initial data will be indicated on the display (Step S10). Thus, it is possible to correct any wrong entry of the data in any previous step by use of the key 5R.

When all the drugs specified in the prescription have been put in the drug preparation tray 1, the tray is hand-carried or transported on a conveyor to a predetermined place. After inspecting and packing the drugs thus collected in trays, they are handed to patients at the pharmacy window. In this embodiment, every time the preparation of drugs for one patient is complete, the data drug preparation data, together with the data denating the time taken for drug preparation, are fed back to a host computer (not shown) and recorded so that such data can be used as a reference for determining how the drug preparation process should be carried out.

What is claimed is:

1. A drug preparation tray comprising:

a box-shaped tray having a drug accommodation area; and, a display apparatus mounted to said tray;

said display apparatus comprising (a) a control unit, (b) an input unit for receiving and supplying to said control unit data indicative of a patient name or code and kinds of drugs which are associated with the patient name or code and which are to be externally prepared and placed in the drug accommodation area of said tray, (c) a display unit connected to said control unit, and (d) a plurality of switches connected to said control unit and respectively corresponding to said kinds of drugs which are to be externally prepared;

said control unit including (a) means for displaying said data supplied from said input unit on said display unit, and (b) means for controlling said display unit in response to the operation of each of said plurality of switches to indicate on said display unit that a kind of drugs corresponding to a corresponding one of said switches has been placed in the drug accommodation area of said tray.

2. A drug preparation tray as claimed in claim 1, wherein said display unit is detachable from said tray.

3. A drug preparation tray as claimed in claim 1, wherein said display unit is integral with said tray.

4. A drug preparation tray as claimed in claim 1, wherein said input unit is a signal transmitter/receiver for receiving said data from an external source in a non-contact manner and supplying said data to said control unit.

5. A drug preparation tray as claimed in claim 1, further comprising a timer key and a reset key, said control unit further including (c) means for indicating, when said timer key is operated, an elapsed time from a time when said input unit received said data, and (d) means for resetting the operation of said switches when said reset key is operated.

6. A drug preparation tray as claimed in claim 4, further comprising a timer key and a reset key, said control unit further including (c) means for indicating, when said timer key is operated, an elapsed time from a time when said input unit received said data, and (d) means for resetting the operation of said switches when said reset key is operated.

7. A drug preparation tray as claimed in claim 5, further comprising an audio signal generating means for generating a sound when all of said switches have been operated or when a predetermined period of time has passed from the time when said input unit received said data.

8. A drug preparation tray as claimed in claim 6, further comprising an audio signal generating means for generating a sound when all of said switches have been operated or when a predetermined period of time has passed from the time when said input unit received said data.

* * * * *